US007717196B2

(12) United States Patent
Völkel et al.

(10) Patent No.: US 7,717,196 B2
(45) Date of Patent: May 18, 2010

(54) ANGLE DRILLING DEVICE

(75) Inventors: Gerhard Völkel, Erndtebrück (DE); Daniel Schmelter, Kirchhundem (DE)

(73) Assignee: TRACTO-TECHNIK GmbH & Co. KG, Lennestadt (DE)

( * ) Notice: Subject to any disclaimer, the term of this patent is extended or adjusted under 35 U.S.C. 154(b) by 41 days.

(21) Appl. No.: 12/024,465

(22) Filed: Feb. 1, 2008

(65) Prior Publication Data

US 2008/0210469 A1 Sep. 4, 2008

(30) Foreign Application Priority Data

Feb. 1, 2007 (DE) ..... 10 2007 005 944

(51) Int. Cl.
*E21B 15/04* (2006.01)

(52) U.S. Cl. ..... 175/220; 175/162; 175/203

(58) Field of Classification Search ..... 175/162, 175/202, 220; 173/185
See application file for complete search history.

(56) References Cited

U.S. PATENT DOCUMENTS 3,520,374 A * 7/1970 Ebert ..... 173/185
3,869,003 A * 3/1975 Yamada et al. ..... 175/171
5,226,488 A * 7/1993 Lessard et al. ..... 175/61
5,647,442 A 7/1997 Lange

FOREIGN PATENT DOCUMENTS

DE 1 216 818 5/1966
DE 28 14 920 C2 9/1982

* cited by examiner

*Primary Examiner*—Giovanna C Wright
(74) *Attorney, Agent, or Firm*—Henry M. Feiereisen; Ursula B. Day

(57) ABSTRACT

In an angle drilling device for introducing or expanding wellbores that are inclined in relation to the horizontal, an angle-adjustable bore rig for a movable feed drive is arranged on a base frame that is movable for example. The bore rig is pivotally connected with the base frame while a connection, for example a link bar, extends between the feed drive and the base frame and has a constant length to effect during travel of the feed drive a change in incline of the bore rig as a consequence of the distance between both pivot points for the bore rig and the point of articulation of the connection.

5 Claims, 2 Drawing Sheets

ANGLE DRILLING DEVICE

CROSS-REFERENCES TO RELATED APPLICATIONS

This application claims the priority of German Patent Application, Serial No. 10 2007 005 944.4, filed Feb. 1, 2007, pursuant to 35 U.S.C. 119(a)-(d), the content of which is incorporated herein by reference in its entirety as if fully set forth herein.

BACKGROUND OF THE INVENTION

The present invention relates to an angle drilling device having a base frame and a feed drive movable on an angle-adjustable bore rig for introducing a rod linkage, typically comprised of several rods for trenchless pipeline construction, into the earth or expanding a wellbore.

Nothing in the following discussion of the state of the art is to be construed as an admission of prior art.

The trenchless pipeline construction for laying of supply and sewer lines from the earth's surface normally requires the use of movable drilling devices by which wellbores, with or without simultaneous introduction of pipelines, can be expanded in relation to the horizontal at a certain angle or introduced into the soil. There are many drilling devices having a bore rig for arrangement of a movable feed drive for an earth drill, drill rod, or also for a linkage comprised of individual rod sections. The inclination angle of the drilling apparatus and the bore rig, respectively, is different in some cases so that the bore rigs are normally arranged pivotally on a base frame. Pivoting is hereby realized with the assistance of one or two hydraulic cylinders or with spindles disposed between the base frame and the bore rig with the feed drive. This adjustment is very complicated in structure and very cost-intensive.

It would therefore be desirable and advantageous to address this problem and to obviate other prior art shortcomings.

SUMMARY OF THE INVENTION

According to one aspect of the present invention, an angle drilling device includes a base frame, a bore rig connected to the base frame at an adjustable angle, and a feed drive movable on the bore rig and linked to the base frame by a connection.

The present invention resolves prior art problems by connecting the feed drive for the drill head with the base frame, whereby the connection may be realized by a link bar, a chain, or a cable.

As a consequence of a distance between both pivot or articulation points of the link bar, on one hand, and the bore rig, on the other hand, on the base frame, it is possible in this way to continuously adjust the inclination angle by simply moving the feed drive which is movable in typical fashion on the bore rig and provided for the drill head or drill. To secure the bore rig after reaching the predefined inclination angle and to secure its position also independently of the feed drive, the bore rig can be arranged between two locking plates which can each be provided with at least one row of holes for placement of insertable pins.

Currently preferred is the provision of each of the locking plates with two rows of holes in spaced-apart relationship, of which the row of holes proximal to the pivot points is intended for securement of the upper angle range and the row of holes distal to the pivot points is intended for securement in the lower angle range.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
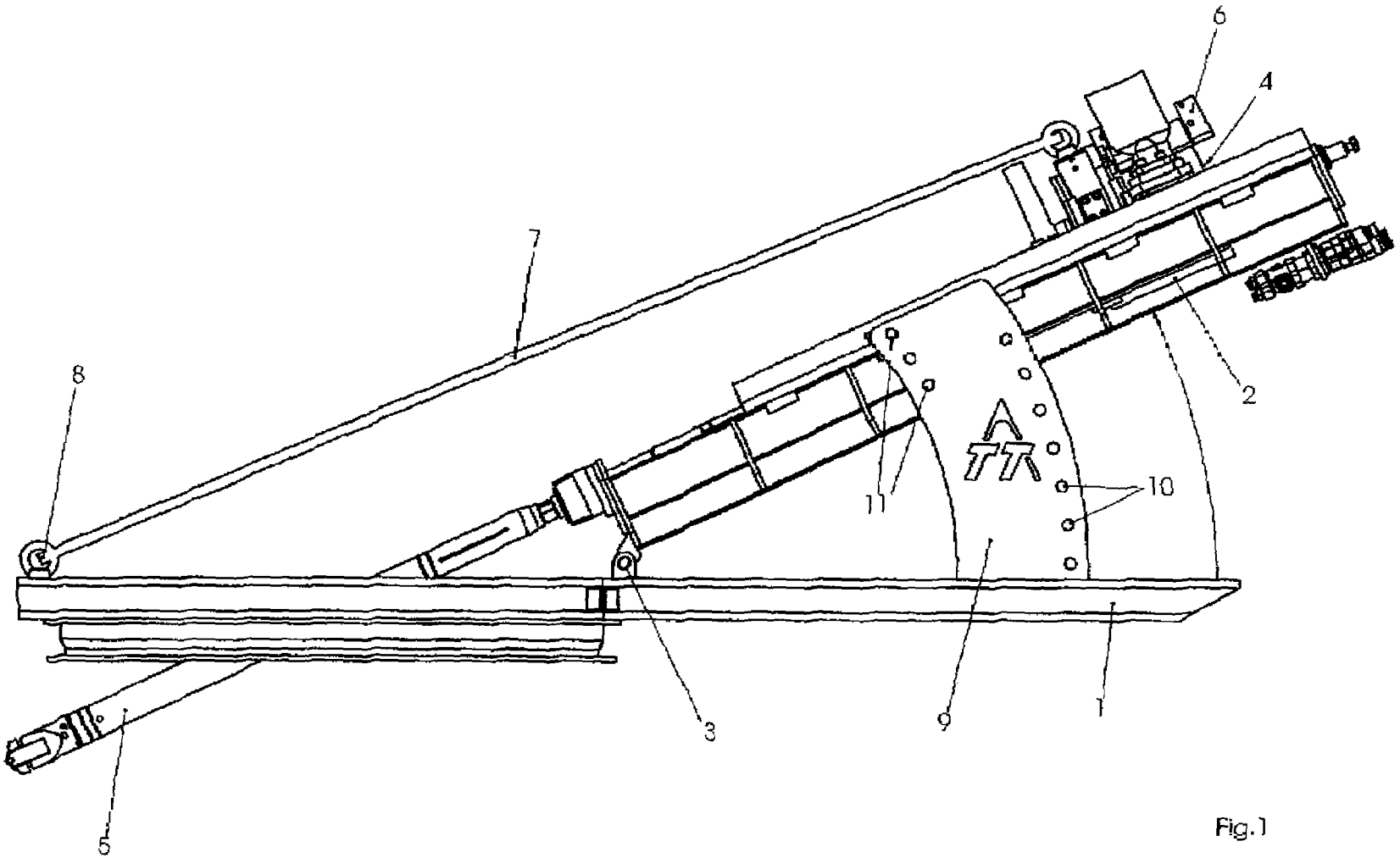
FIG. 1 shows a side view of a top part of an angle drilling device according to the present invention at an angle of inclination.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a side view of a top part an angle drilling device according to the present invention, substantially including a base frame 1, which is arranged on an unillustrated undercarriage, and a bore rig 2, which is pivotally connected to the base frame 1 via a pivot point 3. A carriage 4 having an unillustrated rotary drive for a rock drill is arranged on the bore rig 2. The carriage 4 is further provided with a feed drive 6 which allows movement of the carriage with the drill 5 on the bore rig 2. Furthermore, the carriage 4 is connected to the base frame 1 in a pivot point 8 via a link bar 7. Extending on the base frame 1 on each of both sides of the bore rig 2 is a locking plate 9 formed with two spaced-apart rows of holes 10, 11 for insertion of unillustrated pins for locking the bore rig at a predetermined angular position. Further locking plates 12 extend from the bore rig 2 downwards and have rows of holes positioned behind the rows of holes 10, 11.

Figure 2:
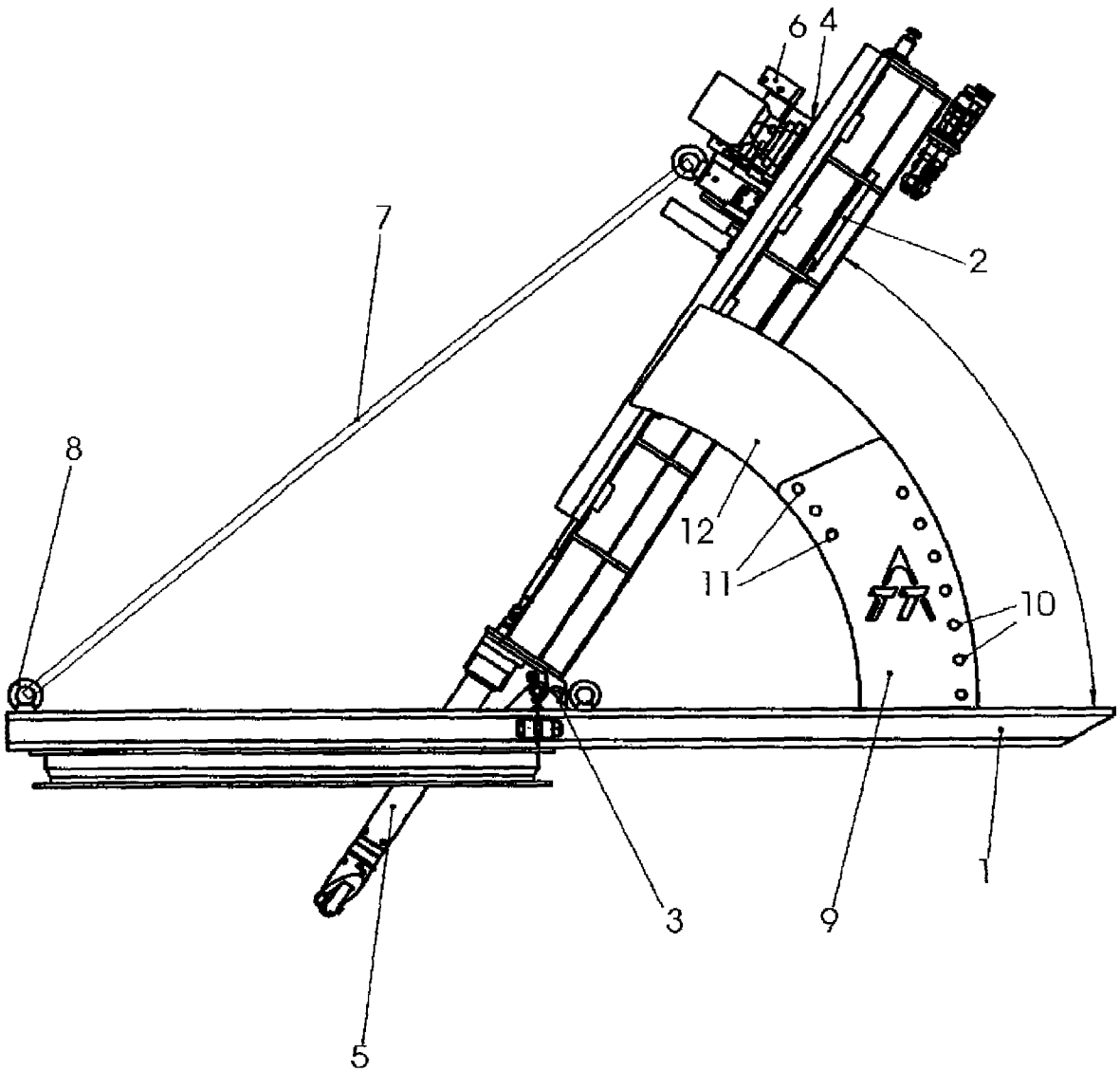
FIG. 2 shows a side view of the angle drilling device illustrated at a greater angle of inclination.

To change the inclination angle of the bore rig 2 with the drill 5 in a manner as shown in FIG. 2, it is only required to remove the pins and to operate the feed drive in typical fashion like for the drill. When desiring an increase of the inclination angle, the carriage is moved on the bore rig 2 to the rear, as shown in FIG. 2. As the distance between the pivot points 3, 8 on the base frame 1 is constant and defined by the link bar 71 the angular position of the bore rig 2 and thus the drilling direction necessarily change.

As soon as the desired incline has been reached, the bore rig 2 is secured in place with the assistance of the pins, and the connection between the link bar 7 and the carriage 4 and/or the base frame 1 is released. As a result, the carriage 4 is movable by the feed drive 6 in typical fashion along the inclined bore rig 2.

In summary, the link bar 7 between the base frame 1 and the carriage 4 thus replaces the conventional pivot drive between the base frame 1, on one hand, and the bore rig 2, on the other hand.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein.

What is claimed is:

1. An angle drilling device, comprising:

a base frame;

a bore rig having one end connected to the base frame for rotation about a first pivot point;

a carriage operatively connected to a drill;

a feed drive mounted on the bore rig for moving the carriage on the bore rig; and a linkage detachably connecting the feed drive to the base frame, said linkage having a feed-drive-distal end which is rotatable about a second pivot point at a fixed distance to the first pivot point on the base frame so that an angular position of the bore rig in relation to the base frame is adjustable by moving the carriage along the bore rig.

2. The angle drilling device of claim 1, wherein the linkage is a link bar.

3. The angle drilling device of claim 1, further comprising a locking assembly for securing the bore rig in place in relation to the base frame, said locking assembly including a first pair of locking plates which are mounted to the base frame on opposite sides of the bore rig, a second pair of locking plates which are mounted to the bore rig on opposite sides thereof and intended for cooperation with the first pair of locking plates, and fastening means for interconnecting the first and second pairs of locking plates.

4. The angle drilling device of claim 3, wherein the first pair of locking plates has at least one row of holes, and the second pair of locking plates has at least one row of holes, wherein the holes in the first and second pairs of locking plates can be brought into alignment for insertion of the fastening means when the bore rig assumes a desired angle of inclination in relation to the base frame.

5. The angle drilling device of claim 3, wherein each of the first and second pairs of locking plates have two rows of holes in spaced-apart relationship, of which the row of holes proximal to the first and second pivot points is intended for securement of an upper angle range and the row of holes distal to the first and second pivot points is intended for securement in a lower angle range.

* * * * *